US006575603B2

(12) United States Patent
Stahl et al.

(10) Patent No.: US 6,575,603 B2
(45) Date of Patent: Jun. 10, 2003

(54) SPLIT REFLECTOR

(75) Inventors: Kurt A. Stahl, Lake Oswego, OR (US); Lawrence J. Gianola, Wilsonville, OR (US)

(73) Assignee: InFocus Corporation, Wilsonville, OR (US)

( * ) Notice: Subject to any disclaimer, the term of this patent is extended or adjusted under 35 U.S.C. 154(b) by 0 days.

(21) Appl. No.: 09/734,984

(22) Filed: Dec. 11, 2000

(65) Prior Publication Data

US 2002/0071280 A1 Jun. 13, 2002

(51) Int. Cl.[7] ..... F21U 7/00

(52) U.S. Cl. ..... 362/346; 362/518; 362/298; 362/343; 362/304; 362/341

(58) Field of Search ..... 362/346, 304, 362/518, 297, 343, 341, 347, 298

(56) References Cited

U.S. PATENT DOCUMENTS

| | | | | | |
|---|---|---|---|---|---|
| 3,919,542 | A | | 11/1975 | Castic | 240/41.55 |
| 4,028,542 | A | | 6/1977 | McReynolds, Jr. | 240/41.36 |
| 4,066,887 | A | * | 1/1978 | Levis | 362/341 |
| 5,636,917 | A | * | 6/1997 | Furami et al. | 362/61 |
| 5,800,048 | A | | 9/1998 | Gordin | 362/275 |
| 6,152,589 | A | * | 11/2000 | Kawaguchi et al. | 362/518 |
| 6,170,962 | B1 | * | 1/2001 | Wordin | 362/247 |
| 6,419,380 | B2 | * | 7/2002 | Oyama et al. | 362/517 |

* cited by examiner

*Primary Examiner*—Sandra O'Shea
*Assistant Examiner*—Anabel Ton

(57) ABSTRACT

A reflector for projection systems and spot (image projecting) luminaires is molded in separate sections and then assembled into a unitary reflector. Forming the reflector in separate sections reduces the amount of surface contact between the reflector and the mold die which in turn substantially reduces the risk of damage or breakage of the reflector section. Each reflector section includes alignment features to assure correct alignment of the sections upon assembly. The reflector sections are formed with edges that mate with edges of an adjacent reflector section along seams to prevent light from showing through the seams. The mating edges preferably include light-blocking features formed by a geometric shape along the seams.

17 Claims, 5 Drawing Sheets

FIG. 5
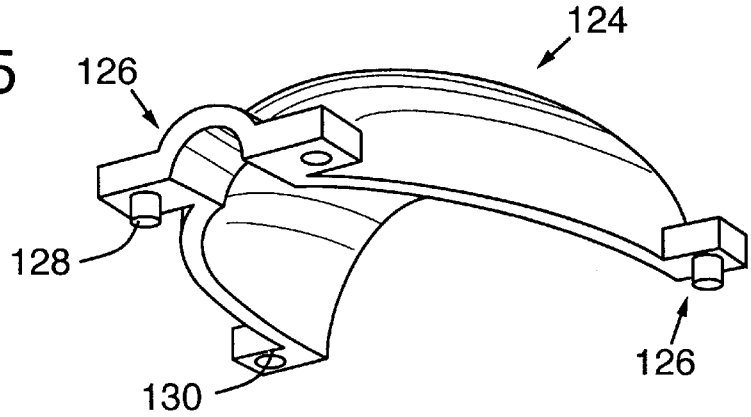
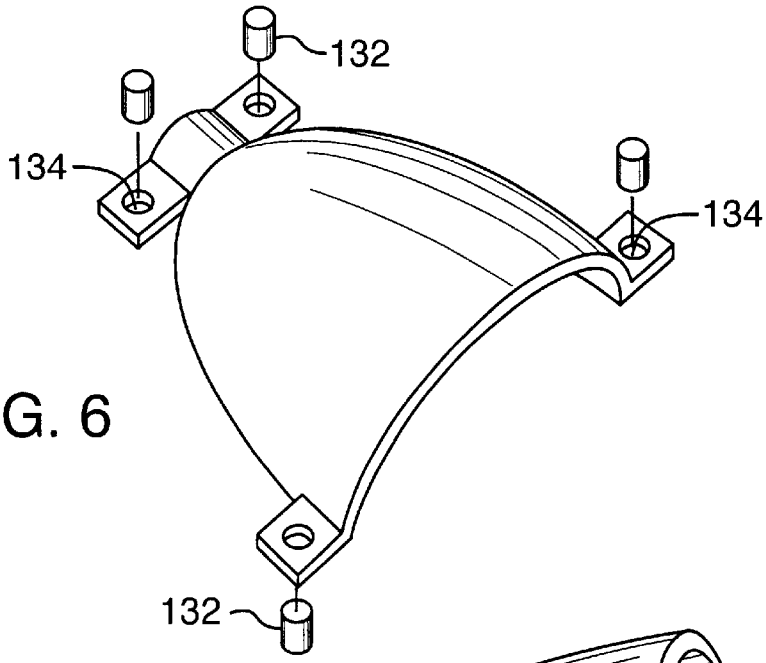
FIG. 6
FIG. 7
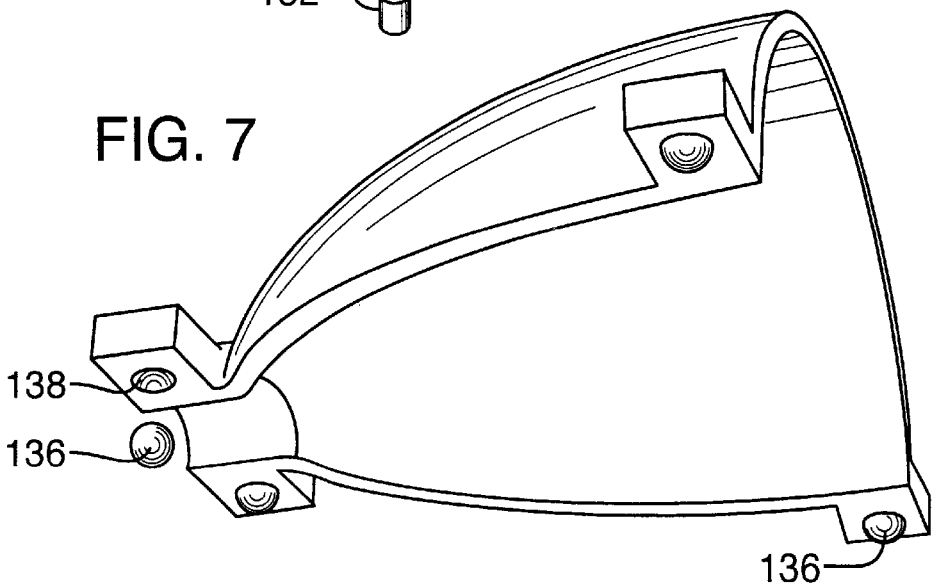

SPLIT REFLECTOR

TECHNICAL FIELD

The present invention is directed to light reflectors and, in particular, to a split conic and/or aspheric reflector and method of performing post processing applications such as polishing and/or coating the reflecting surface.

BACKGROUND OF THE INVENTION

Conic and/or aspheric reflectors, such as paraboloidal, ellipsoidal, and aspheric reflectors are commonly used in today's data and video projection systems where efficient collection and redirection of light from a lamp is required. These reflectors are used in projection systems and spot (image projecting) luminaires. Such reflectors may also be used in other areas such as in entertainment lighting, such as, for example, wash luminaires, and in scientific illumination, such as, for example, high intensity light for spectroscopy. Current reflectors are made in large quantities by molding methods and in small quantities by electro-forming, pressing, diamond turning or other mechanical methods. In order to optimize the reflector's efficiency, they are usually coated with multilayer optical coatings and are sometimes polished after molding but prior to coating.

FIG. 1 illustrates one type of device in which reflectors are used wherein an image projector 10 includes a high power lamp 12 that employs a one-piece reflector 14. The lamp 12 produces a high powered beam 16 that propagates through a rotating color wheel 18 of a color wheel assembly 20. Color wheel 18 includes at least three sectors, each tinted in a different one of three primary colors to provide a field sequential color image capability for image projector 10. The beam is directed by a mirror 32 that is inclined so that the beam propagates through a prism component 42 and through a projection lens 64 to a projector screen (not shown) to display an image to a viewer. Most reflectors 14 used in current image projectors 10 are molded as a one-piece unit. It is to be understood that the image projector 10 shown in FIG. 1 represents only one example of a device employing a reflector to which the invention is directed.

One problem that exists with reflectors that are molded in one piece is that it is difficult to remove the reflector from the mold. Typically, reflectors are molded by forcing molten glass into a metal mold having a cavity formed between an inner die core and an outer mold body. When the glass has cooled sufficiently the mold parts are pulled away from the reflector. It can be difficult to remove the reflector from the inner die core without breaking the reflector due to its shape. This problem is best illustrated in FIG. 2, which shows a molded glass reflector 80 and an inner die core 82. The glass reflector 80 is generally removed from the inner die core 82 by pulling it in the direction of arrow 84. A line of tangency 86 can be established at any point of contact between the inner surface 88 of the reflector 80 or the outer surface 90 of the inner die core 82 forming what is known as the draft angle 92 with a horizontal plane parallel to the direction of removal of the inner die core 82. As the draft angle 92 decreases, the friction between the reflector 80 and the inner die core 82 increases. There is a point at which the draft angle 92 cannot be less than a minimum without damage to the reflector 80. The minimum draft angle is determined by several factors such as, for example, the thickness of the glass and the length of the draft region. The minimum draft angle may vary a few degrees; however, it has been found that the preferred minimum draft angle is about 5 degrees.

If the draft angle is less than about 5 degrees, the reflector 80 cannot be properly removed from the inner die core 82. This is difficult to achieve when fabricating one-piece reflectors because it would require the reflector 80 to have a less than desirable length resulting in less light collection and a less efficient projection system.

As shown in FIG. 2 the area represented at 96 illustrates draft region or the area of contact between the reflector 80 and the inner die core 82 in which the draft angle is about 4 degrees which is less than the preferred minimum draft angle, which may result in reflector breakage or loss.

Furthermore, the post processing operations such as polishing and coating of the reflectors becomes difficult as the diameter or overall size of the reflector decreases and as the depth or extent increases. The primary problem here is essentially one of not being able to adequately reach the entire interior reflecting surface.

It is therefore desirable to provide a conic and/or aspheric reflector that can be more readily removed from the mold. It is also desirable to provide such a reflector in which the reflective surface is more accessible for performing post processing operations such as polishing and coating.

SUMMARY OF THE INVENTION

The present invention provides for a method of manufacturing a conic and/or aspheric reflector in which the reflector is manufactured in two or more sections and later assembled to form a unitary reflector. Forming the reflector in sections eliminates the difficulty of removing the reflector sections from their associated mold caused by problems related to the draft angle.

Manufacturing the reflector in two or more sections also provides better access to the inner reflective surfaces of the sections for such post processing operations as polishing and coating the inner reflective surface.

Each section is accurately indexed with respect to the other section to achieve a smooth and continuous reflecting surface. The resulting assembled reflector accurately reproduces the shape of a one piece reflector.

The mating faces of the reflector sections can be ground, if necessary, after molding if they are not flat enough directly from the mold. It is important for the mating surfaces to be flat to achieve best optical efficiency. The gap between the mating faces of the reflector sections needs to be minimized in order to achieve a nearly continuous optical surface.

Additionally, light-blocking features can be added to the mating faces of the reflector sections to minimize and or eliminate any possible escape of light from the reflector. Such features may take a plurality of different geometrical forms. However, what is achieved by the light-blocking features is a surface in which there is no gap in the seam formed by the mating surfaces which allows light to escape. The light blocking features include some geometrical overlap along the mating edge seam to prevent stray light from escaping from the interior surface of the reflector through to the exterior of the reflector along the joint seam. Such light blocking configurations might include, for example, a lap joint, a V-groove joint, or curved mating surfaces.

The reflector sections may be held together and indexed relative to each other by various features such as, for example, pins that align with mating seats in an adjacent reflector section. Such alignment pins may be integral with the reflector section or may be separate and adhered or mechanically held in place. Other alignment features may include separate spheres, rivets, cones, truncated cones, wedges, and flats.

The present invention removes the limitation in the size and shape of conic and/or aspheric reflectors which can be cost effectively fabricated. The split conic and/or aspheric reflector approach allows small diameter and/or deep reflectors of this type to be more easily fabricated by either molding or direct machining and, if needed, more easily post-polished and coated. This is most beneficial when the length of extent of the reflector is large compared to the diameter of the reflector.

The split reflector assembly also may offer the benefit of reducing the level of thermal stress experienced by the assembled reflector compared to one piece reflectors. This is achieved by allowing the reflector to expand and/or contract due to heating or cooling without letting light escape from the reflector.

It is an object of this invention to provide a reflector for a projection system that is manufactured in at least two sections.

It is another object of this invention to provide a reflector that is manufactured by a method that provides ease of removal from a mold die.

Another object of this invention is to provide a reflector manufactured by a process that eliminates problems associated with the draft angle.

It is yet another object of this invention to provide a reflector for a projection system that is easily fabricated to provide access to the reflecting surface for post-fabrication processing such as polishing and coating.

Still another object of the invention to provide a split reflector for a projection system that has a substantially continuous reflecting surface.

It is a further object of the invention to provide a split reflector in which the mating surfaces include light blocking features to prevent light from escaping from the interior surface to the exterior of the reflector.

Yet another object of the invention is to reduce the level of thermal stress experienced by the assembled reflector.

Additional objects and advantages of this invention will be apparent from the following detailed description of preferred embodiments thereof which proceeds with reference to the accompanying drawings.

BRIEF DESCRIPTION OF THE DRAWINGS

FIG. 5 is an isometric view of one reflector section with alignment pins.

FIG. 6 is an isometric view of one reflector section with separate alignment pins.

FIG. 7 is an isometric view of one reflector section having alignment spheres.

DETAILED DESCRIPTION OF PREFERRED EMBODIMENTS

The present invention provides for a reflector assembly that is molded in separate sections and then assembled together to form a unitary reflector. Each reflector section is formed in a rigid mold by various fabrication processes, such as, for example, pouring molten glass into the mold. When the glass cools sufficiently the reflector section is removed from the mold. Since the reflector is molded in separate sections it may be removed from the mold in a manner preventing damage or breakage to the reflector section.

Figure 1:
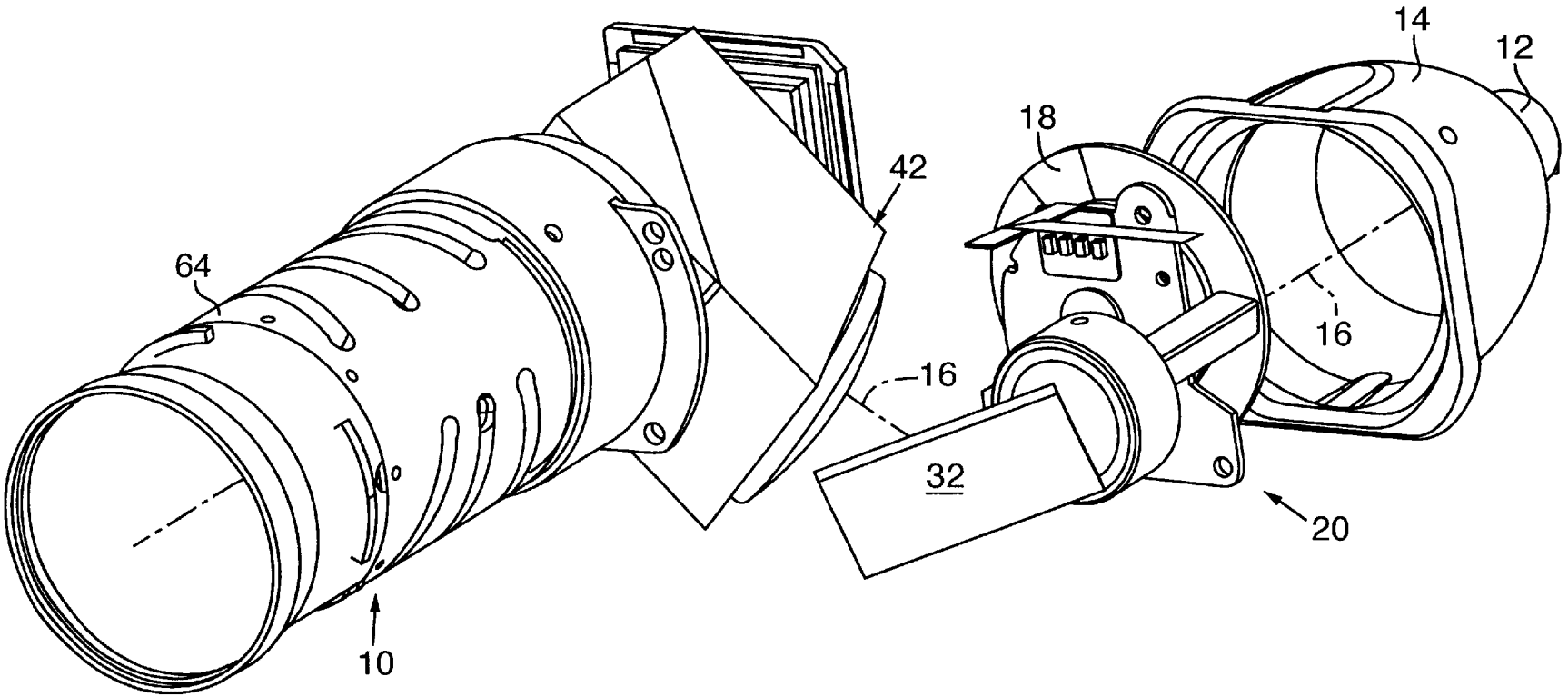
FIG. 1 (PRIOR ART)
FIG. 1 is a perspective view of a prior art image projector partly disassembled showing a high powered lamp including a one-piece reflector.
Figure 2:
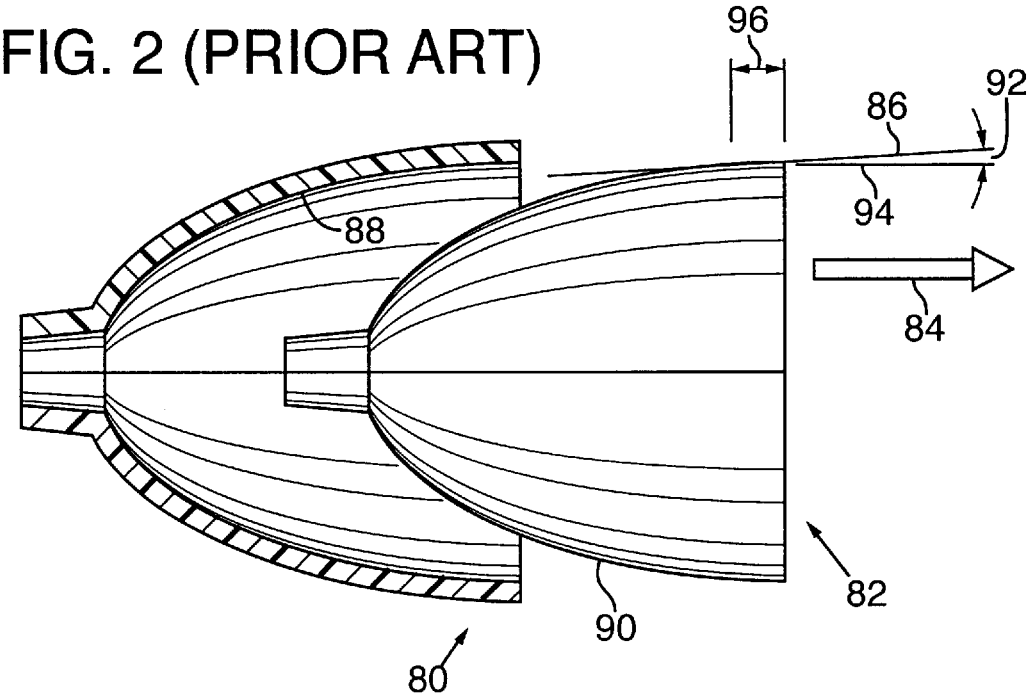
FIG. 2 (PRIOR ART)
FIG. 2 is a simplified side view of a prior art one-piece reflector shown in section and an associated mold die.
Figure 3:
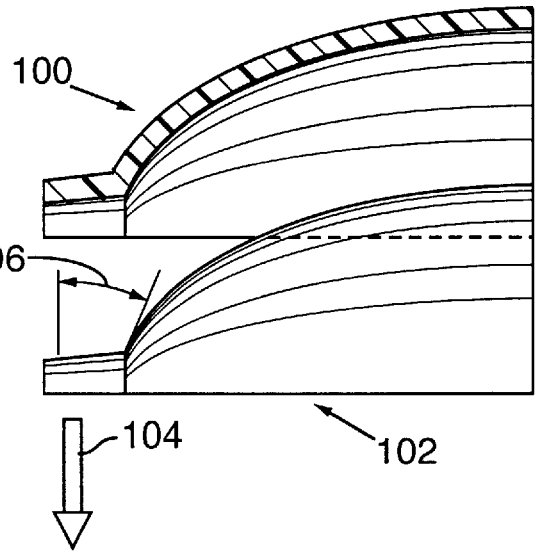
FIG. 3 is a simplified side view of one reflector section and its associated mold die in accordance with the present invention.
Figure 4:
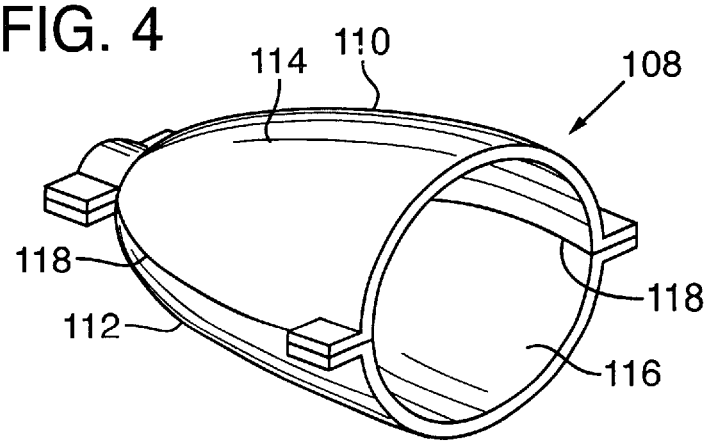
FIG. 4 is an isometric view of the reflector sections shown assembled into a unitary reflector.
Figure 8:
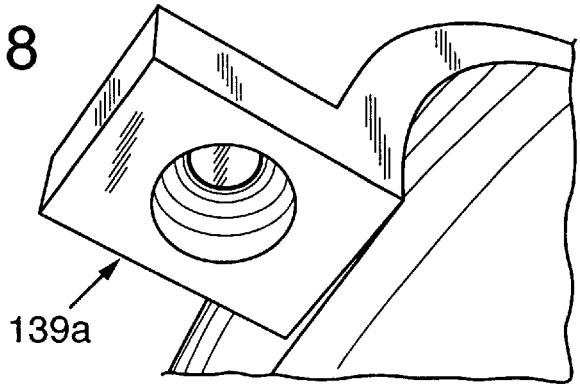
FIG. 8 is an enlarged partial isometric view of an alignment feature in the form of a truncated cone.
Figure 9:
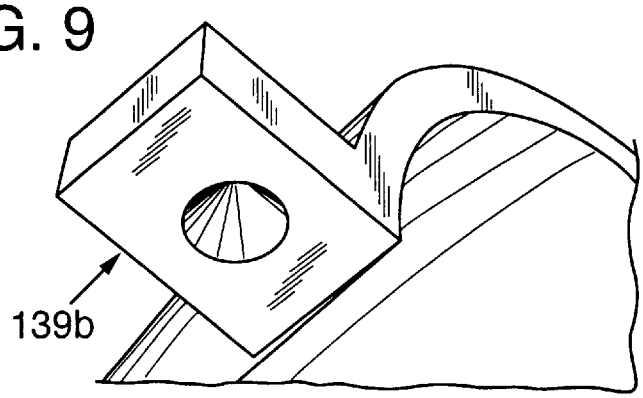
FIG. 9 is an enlarged partial isometric view of an alignment feature in the form of a cone.
Figure 10:
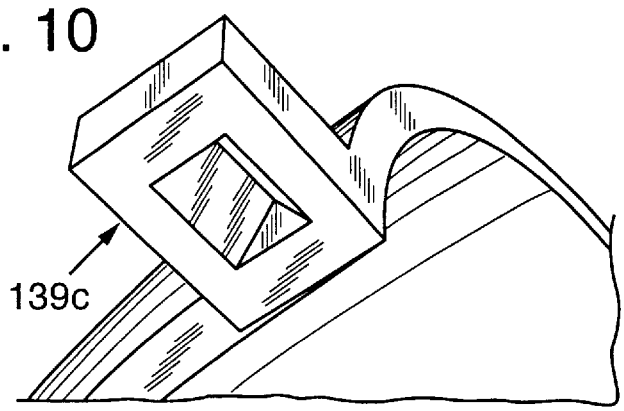
FIG. 10 is an enlarged partial isometric view of an alignment feature in the form of a wedge.

With reference to FIGS. 3 and 4, a portion of a reflector section 100 is shown with its associated mold die 102. As can be clearly seen the reflector section 100 and mold die 102 are separated in the direction of arrow 104. This substantially eliminates any frictional forces that would develop between the surfaces of the reflector section 100 and the mold die 102 during removal in areas that form small draft angles. As seen in FIG. 3, since the reflector section 100 and mold die 102 are separated in the direction shown, the smallest draft angle formed between the surfaces of the reflector section 100 and mold die 102 is about 23 degrees in the area represented at 106 which is well in excess of the minimum draft angle. After the reflector section 100 is separated from its associated mold die 102 it is assembled with another reflector section into a unitary reflector 108 as seen in FIG. 4.

Figure 12:
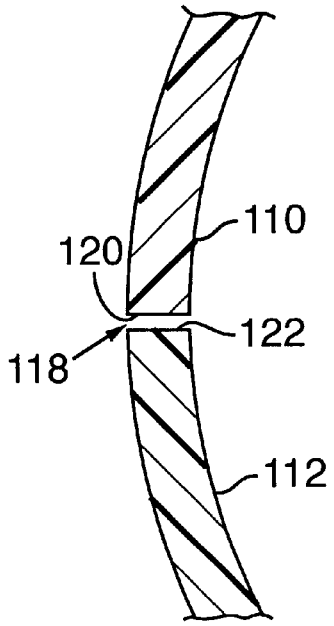
FIG. 12 is an enlarged partial view of the flat mating edges of adjacent reflector sections.

Each reflector section 110 and 112 is preferably molded to form a conic and/or aspheric section having an outer surface 114 and an inner reflective surface 116. The reflector sections 110 and 112 are formed with mating edges that are aligned with the mating edges of the adjacent reflector section to form a seam 118. The mating edges 120 and 122, as seen, for example, on reflector sections 110 and 112 in FIG. 12 are molded with flat surfaces that are, preferably, precisely flat enough from the mold so that substantially no gap exists between the mating edges 120 and 122 to prevent light from escaping through the seam 118. However, if necessary, the flat surfaces of the mating edges 120 and 122 may be ground to precise flatness after removal from the mold.

Figure 11:
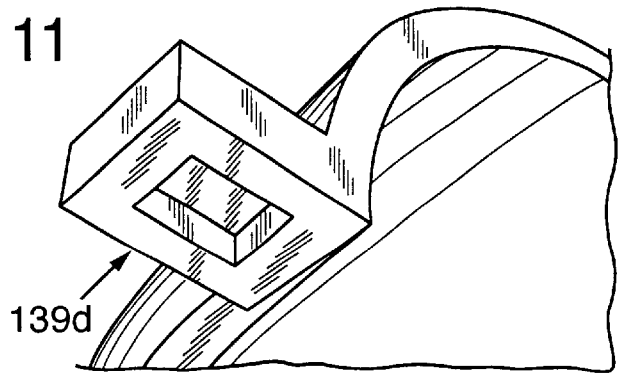
FIG. 11 is an enlarged partial isometric view of an alignment feature in the form of a flat.

As seen in FIGS. 5–11 reflector section 124 may include alignment features 126 so that the mating edges are accurately aligned upon assembly to provide a substantially smooth and continuous surface. The alignment features may include integral alignment pins 128 and holes 130 (FIG. 5) that cooperate with alignment pins and holes of an adjacent reflector section (not shown). Alternatively, separate alignment pins 132 (FIG. 6) may be inserted and secured in holes 134 by any desired manner for cooperation with corresponding alignment holes in an adjacent reflector section (not shown). The alignment features may also be in the form of spheres 136 (FIG. 7) that are inserted and secured in holes 138 to cooperate with alignment holes of an adjacent reflector section (not shown). FIGS. 8–11 show alignment features in the form a truncated cone 139*a* (FIG. 8), a cone 139*b* (FIG. 9), a wedge 139*c* (FIG. 10), and a flat 139*d* (FIG. 11). It should be understood that an adjacent reflector section for mating with the alignment features of FIGS. 8–11 would include a corresponding mating element similar to the alignment features shown in FIGS. 5–7. The corresponding mating element may have the same or different geometric form as the element in the adjacent reflector section. It should also be understood that the invention is not limited to the alignment features shown and described and that other alignment features may be used.

Figure 13:
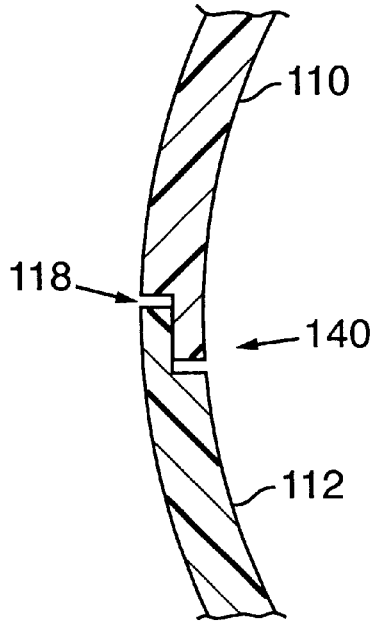
FIG. 13 is an enlarged partial view of an alternative configuration of the mating edges of adjacent reflector sections in the form of a lap joint.
Figure 14:
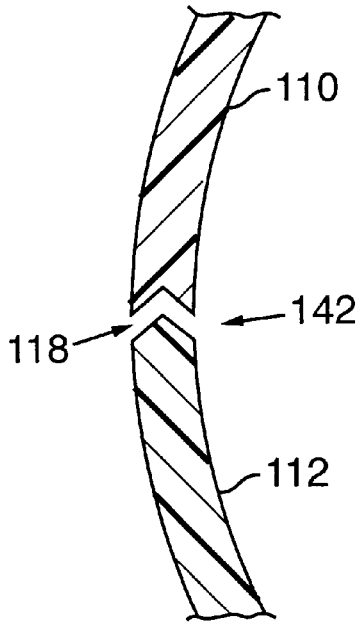
FIG. 14 is an enlarged partial view of an another alternative configuration of the mating edges of adjacent reflector sections in the form of a V-groove.
Figure 15:
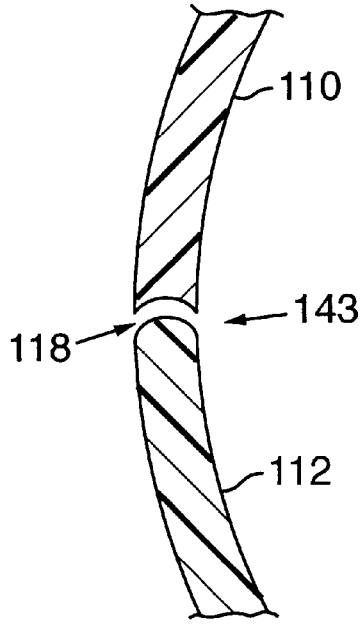
FIG. 15 is an enlarged partial view of another alternative configuration of the mating edges of adjacent reflector sections in the form of curved surfaces.

In order to ensure that no light escapes through the seam 118 of the assembled reflector 108 (FIG. 4) the mating edges of the reflector sections may include light blocking features. As seen in FIGS. 13–15 the light blocking features may include a variety of shapes. For example, the mating edges may be in the form of a lap joint 140 (FIG. 13), a V-groove joint 142 (FIG. 14), or curved mating surfaces 143 (FIG. 15). These are just examples of geometric configurations that may be used as light blocking features and it should be understood that the mating edges could be configured with other geometric features to block light.

The reflector assembly 108 of the present invention also reduces the level of thermal stress caused by expansion and contraction due to temperature variations. Reduction of thermal stress is achieved because the reflector assembly 108 expands and contracts along the seam 118 thus reducing internal stresses in the reflector sections 110 and 112. The light blocking features 140, 142, and 143 effectively prevent light from escaping through the seam 118.

Although the split reflector is shown and described as comprising only two sections it will be understood that the reflector may be fabricated in more than two sections.

It will be understood that variations and modifications may be effected without departing from the spirit and scope of the novel concepts of this invention.

It will be obvious to those having skill in the art that many changes may be made to the details of the above-described embodiments of this invention without departing from the underlying principles thereof. The scope of the present invention should, therefore, be determined only by the following claims.

What is claimed is:

1. A reflector, comprising:

a first reflector section and a second reflector section assembled to have respective first and second confronting inner surfaces from which light propagating from a lamp reflects to project an image, the first and second reflector sections have mating edges that form a seam where they meet, wherein the mating edges of the first and second reflector sections are of shapes and are arranged to form at the seam a light blocking feature that prevents light from escaping through the seam; and alignment features provided on the first and second reflector sections.

2. The reflector of claim 1, wherein the mating edges are substantially flat.

3. The reflector of claim 1, wherein the mating edges are of complementary shapes that form at least one light-blocking feature.

4. The reflector of claim 1, wherein the mating edges of the first and second reflector sections form a lap joint.

5. The reflector of claim 1, wherein the mating edges of the first and second reflector sections are in the form of a V-groove joint.

6. The reflector of claim 1, wherein the mating edges of the first and second reflector sections are in the form of curved surfaces.

7. The reflector of claim 1, wherein the light-blocking feature is in the form of a lap joint.

8. The reflector of claim 1, wherein the light-blocking feature is in the form of a V-groove joint.

9. The reflector of claim 1, wherein the light-blocking feature is in the form of curved surfaces.

10. The reflector of claim 1, wherein the alignment features include an alignment pin on one of the first and second reflector sections and an alignment hole on the other of the first and second reflector sections for receiving the alignment pin.

11. The reflector of claim 10, wherein the alignment pin is integral with its associated one of the first and second reflector sections.

12. The reflector of claim 10, wherein the alignment pin is separate from its associated one of the first and second reflector sections.

13. The reflector or claim 1, wherein the alignment features include an alignment sphere on one of the first and second reflector sections and an alignment hole on the other of the first and second reflector sections.

14. The reflector of claim 1, wherein the alignment features are in the form of a cone.

15. The reflector of claim 1, wherein the alignment features are in the form of a truncated cone.

16. The reflector of claim 1, wherein the alignment features are in the form of a wedge.

17. The reflector of claim 1, wherein the alignment features are in the form of a flat.

* * * * *